US006338306B1

(12) United States Patent
Perrone

(10) Patent No.: US 6,338,306 B1
(45) Date of Patent: Jan. 15, 2002

(54) ASH HANDLING SYSTEM

(75) Inventor: Paul E. Perrone, Lynchburg, VA (US)

(73) Assignee: Applied Synergistics, Inc., Lynchburg, VA (US)

( * ) Notice: Subject to any disclaimer, the term of this patent is extended or adjusted under 35 U.S.C. 154(b) by 0 days.

(21) Appl. No.: 09/691,562

(22) Filed: Oct. 18, 2000

(51) Int. Cl.[7] ..... F23N 5/20; F23J 1/02

(52) U.S. Cl. ..... 110/342; 110/191; 110/192; 110/185; 110/165 R; 110/169; 110/165 A

(58) Field of Search ..... 110/191, 192, 110/185, 233, 343, 342, 165 R, 166, 167, 169, 165 A, 113; 432/43, 113, 152, 239; 266/96

(56) References Cited

U.S. PATENT DOCUMENTS

| | | | | | |
|---|---|---|---|---|---|
| 1,943,780 | A | * | 1/1934 | Allen | 302/52 |
| 2,493,960 | A | * | 1/1950 | Gladden | 110/165 |
| 3,771,470 | A | * | 11/1973 | Hampton | 110/8 R |
| 4,112,856 | A | | 9/1978 | Fuhrman et al. | |
| 4,363,571 | A | * | 12/1982 | Jackson et al. | 406/56 |
| 4,466,558 | A | * | 8/1984 | Dugge et al. | 222/195 |
| 4,628,828 | A | | 12/1986 | Holtham et al. | |
| 4,887,539 | A | | 12/1989 | Magaldi | |
| 5,207,164 | A | | 5/1993 | Breen et al. | |
| 5,255,615 | A | | 10/1993 | Magaldi | |
| 5,462,236 | A | * | 10/1995 | Knepler | 241/34 |
| 5,603,458 | A | * | 2/1997 | Sandolo | 241/34 |
| 5,715,762 | A | * | 2/1998 | Reilly | 110/165 R |
| 5,775,237 | A | | 7/1998 | Reilly et al. | |
| 5,782,201 | A | * | 7/1998 | Wells | 119/57.4 |
| 5,797,334 | A | * | 8/1998 | Weitzel | 110/245 |
| 6,216,612 | B1 | * | 4/2001 | Hume et al. | 110/345 |

FOREIGN PATENT DOCUMENTS

JP 07103449 A * 4/1995

* cited by examiner

*Primary Examiner*—Henry Bennett
*Assistant Examiner*—K. B. Rinehart
(74) *Attorney, Agent, or Firm*—Maccord Mason PLLC

(57) ABSTRACT

An apparatus and method is provided for discharging ash from a plurality of fossil-fuel boiler hoppers through actuator opened gate valves by opening only selected gate valves during a given discharge cycle and bypassing other hoppers. The time required to discharge a given hopper is determined and compared with a desired time range that would be required to discharge the hopper, if the hopper was filled to a desired percentage. Opening of a given hopper during subsequent cycles is based on a comparison of the actual discharge time with a desired discharge time range. If the actual discharge time is less than the minimum time of the desired time range, a time increment is assigned to the given hopper, and the hopper is bypassed on subsequent cycles until the assigned time increment has expired.

20 Claims, 2 Drawing Sheets

ASH HANDLING SYSTEM

BACKGROUND OF THE INVENTION (1) Field of the Invention

The present invention relates generally to an apparatus and method for discharging ash from fossil-fired boiler hoppers, and in particular to an apparatus and method for controlling the discharge sequence of a plurality of ash-collection hoppers to optimize discharge and minimize unnecessary hopper activation.

(2) Description of the Prior Art

A large quantity of bottom ash and fly ash is produced when burning coal in steam boilers. Bottom ash is generally the larger, heavier ash that falls downward from the furnace area, while fly ash is the fine, fluffy air-borne ash that is removed from exhaust gases, usually with electrostatic precipitators, and later collected for disposal. Generally, both types of ash fall, or are conveyed, to a plurality of adjacent hoppers that are positioned in the lower part of the boiler to collect bottom ash, and below the precipitator to collect fly ash. Depending upon the boiler design, as many as forty hoppers may be used for ash collection.

These hoppers are generally comprised of an ash container with inwardly angled sidewalls having lower edges that terminate in a discharge opening, and a moveable gate valve that closes the opening. The hopper is periodically discharged by opening the valve to transfer the ash to an ash conveyor, such as belt or conduit. For example, the gate valve may connect the hopper to a conduit that includes a vacuum source to draw the ash from the hopper and through the conduit to convey the ash to a remote location for further processing or disposal.

Opening of the gate valve is controlled by an actuator, e.g., an electrical or pneumatic actuator, to move the gate valve between closed and open positions. Each hopper valve has a separate actuator, so that the valves of multiple hoppers are individually controlled. In normal operation, only one of a plurality of hoppers is discharged at a given time so that downstream components, e.g., conduits and vacuum devices, can be economically sized to one hopper capacity.

Sequential opening of the hopper valves is effected by controlling the valve actuators with a discharge controller that is set to open each of the hoppers individually in sequence. That is, the valve of a first hopper is opened and the hopper is discharged. After the first hopper valve is returned to the closed position, the valve of the next hopper in sequence is opened. This sequential opening is continued until all of the hoppers have been discharged, and the opening cycle is then repeated.

In many boilers, each hopper is maintained in the open position for a predetermined time, even if the hopper is discharged in a lesser time. Thus, the hopper may remain open for a significant time with no ash being discharged from the hopper, reducing the overall efficiency of the system, and accelerating deterioration by exposing the hopper to hot gases.

In other boilers, one or more vacuum sensors are included to sense when each hopper is discharged, and to transmit sensed information to the controller. When a discharged condition is sensed, the discharge controller is set to close the valve of the discharge hopper and open the valve of the next hopper in sequence. In some boilers, the valves are modulated instead of being fully opened and closed. As used herein, opening and closing of the valves is intended to encompass this alternative.

Ash hoppers do not fill with ash at the same rate. However, it is necessary to set the timing of the opening sequence to ensure that a hopper does not fill beyond its capacity between discharge times. Thus, since the hoppers are opened in sequence regardless of the amount of ash that is in the individual hoppers, many hoppers are unnecessarily opened when there is very little ash to discharge.

Opening and closing of hopper gate valves consumes energy, and causes wear on the gates. Further, sequencing of discharges from hoppers that are only partially filled reduces the efficiency of the overall system. Thus, an apparatus and method for opening boiler gate valves only when the hoppers are substantially filled would be of considerable value.

SUMMARY OF THE INVENTION

The present invention addresses this need by providing an apparatus and method for controlling the opening sequence of fossil-fired boiler ash hoppers, and fossil-fired boilers incorporating the apparatus and utilizing the method.

Generally, the apparatus of the present invention is designed for use with a fossil-fueled boiler having a plurality of adjacent ash collection hoppers, each hopper including a gate valve and a valve actuator to open and close the gate valve. The boiler will also include a conveyor for transferring ash from the hoppers to a remote destination for disposal or further processing. The conveyor, for example, may be a primary conduit communicating with the hoppers through secondary conduits that join the hoppers to the primary conduit through the gate valves. A vacuum source may be present to draw ash from the hoppers through the secondary and primary conduits. It will be apparent to one skilled in the art after reading the present description that the apparatus of the present invention can be used with fossil-fueled boilers of other constructions, and boilers with additional features, such as additional valves in the discharge conduits, e.g., branch valves at the juncture of the secondary and primary conduits.

The present apparatus is comprised of at least one sensor to measure the length of time required to discharge each of the hoppers; and a controller to receive information from the sensor or sensors and send control signals to the actuators dependent upon the sensed times. As used herein, the term "discharge" and derivations thereof, is intended to refer to the act of removing a desired amount, normally substantially all, of the ash from a hopper. The discharging of a hopper may collectively involves several actions, including the opening of the hopper's gate valve and any other valves in the discharge conduit, and the application of a suction to the hopper to draw ash into the conduit.

The controller is initially programmed to open each hopper valve in sequence, with each hopper being opened for a predetermined time. When the valve of a given hopper is opened, a sensor measures the time required to discharge the hopper. This sensor may be unique to the given hopper, e.g., each hopper may have its own sensor. Alternatively, a common sensor may be used to measure the times required to open all hoppers. For example, a vacuum sensor, similar to that mentioned above, can be used to measure the time required to discharge a given hopper by determining the time when the valve is opened, and the time when the hopper resistance drops below a given value.

The controller is programmed with a desired discharge time range determined by a minimum discharge time and a maximum discharge time. The maximum discharge time will normally be equal to, or slightly less than, the time that the hopper valve is open during a cycle, while the minimum discharge time will be less than the maximum discharge time.

If the time required to discharge a given hopper is within the desired time range, no adjustment is made to the system. However, if the time required to discharge the hopper is less than the minimum discharge time, the opening sequence will need to be adjusted to avoid unnecessary opening of the given hopper. Therefore, the controller adds a time increment to the given hopper. The length of this time increment will depend on various factors, including the number of hoppers being discharged, the time required to discharge a full hopper, and the time that the sensor indicates as actually required to discharge the given hopper.

During the next and subsequent cycles, opening of the given hopper valve is skipped, until the assigned time increment expires. The given hopper valve is then discharged on the next cycle. If the hopper is discharged in a time within the range, no adjustment is made, and the existing time increment is reassigned. However, if the hopper is again discharged in a time less than the minimum discharge time, an additional time increment will be added to the initial time increment for the given hopper to create a second or revised time increment that is used to determine the time of the next discharge. Opening of the hopper will then be skipped for one or more cycles until the revised time increment, i.e., the sum of the initial time increment and the added time increment expires. The added time increment is not a fixed time or percentage and may vary depending upon various factors including those noted previously, e.g., the number of hoppers being discharged, the time required to discharge a full hopper, and the time that the sensor indicates as actually required to discharge the given hopper.

This procedure will be repeated on subsequent cycles until the time required to discharge the hopper falls within the desired range. Similar adjustments will be made for all hoppers. Thus, when the system reaches "steady-state" operation, each hopper that does not discharge within the desired discharge time range will have a time increment assigned by the controller, so that any given hopper will be bypassed during discharge cycles until the hopper's assigned time increment has expired. The hopper is then discharged, and the existing or revised time is assigned.

In some systems, there may be a risk that a hopper will overflow if the actual time required to discharge the hopper exceeds the time that the hopper gate valve is opened on a given cycle. In order to avoid this risk, the timing of the cycles and the hopper opening time within a cycle is preferably set so that all hoppers are discharged in less than the preset time that the hopper is open. Then, a time increment will be added to each hopper, so that none of the hoppers will be opened for one or more subsequent cycles.

On subsequent cycles when the hoppers are again opened, some of the hoppers may discharge within the desired time range. The time increment for these hoppers will be maintained. Some hoppers may discharge in less than the minimum discharge time. The time increment for these hoppers will be increased. Some hoppers may not discharge by the maximum discharge time. The time increment for these hoppers will be reduced.

The assigned time increments will then be maintained, increased or decreased on subsequent cycles until all hoppers are discharged within the desired time range. The time to discharge each hopper will then be monitored on each subsequent cycle in which the hopper is opened. If operating conditions change so that the time required to discharge a given hopper increases or decreases, the given hopper's assigned time increment will be adjusted accordingly.

Thus, the sequence for any given hopper comprises the initial step of discharging the hopper, comparing the actual time required to discharge the hopper with a desired time range having a minimum time and a maximum time, assigning a time increment to the given hopper if the actual time is less than the minimum time, and discharging the hopper again on a subsequent cycle only after the assigned time increment has expired. If the actual time required to discharge the hopper is above or below the desired time range when the hopper is discharged on the subsequent cycle, the assigned time increment is increased or decreased accordingly.

When there is a need to ensure that a given hopper does not overflow because the actual time to discharge the hopper significantly exceeds the actual hopper opening, the frequency of the cycles and the desired time range will be set to ensure that the actual time to discharge the given hopper on an initial cycle will be less than the minimum time of the desired time range. As a result, an increment of time will be assigned to the given hopper, so that the given hopper will be skipped or bypassed on one or more subsequent cycles. Then, if the actual time required to discharge the given hopper on a subsequent cycle is greater than the upper limit of the desired range, the time increment can be decreased to reduce the number of skipped cycles.

Thus, it is an aspect of the present invention to provide a method for discharging ash from a plurality of fossil-fuel boiler hoppers by opening only selected hoppers during a given discharge cycle and bypassing other hoppers comprising assigning initial time increments to given hoppers based on a comparison of the actual time required to discharge the given hopper and a desired time range, and bypassing opening of hoppers having unexpired assigned time increments.

It is another aspect of the invention to provide an apparatus for discharging ash from a plurality of fossil-fueled boiler hoppers, each having a gate valve comprising an actuator associated with each gate valve, at least one sensor to detect when each hopper is discharged, and a controller regulating opening of selected gate valves during a given discharge cycle, the gate valves being selected based on information received from the sensor.

These and other aspects of the present invention will become apparent to one skilled in the art upon reading the detailed description of the invention that follows, taken together with the drawings.

DETAILED DESCRIPTION OF THE INVENTION

In the following description, terms such as horizontal, upright, vertical, above, below, beneath, and the like, are used solely for the purpose of clarity in illustrating the invention, and should not be taken as words of limitation. The drawings are for the purpose of illustrating the invention and are not intended to be to scale.

Figure 1:
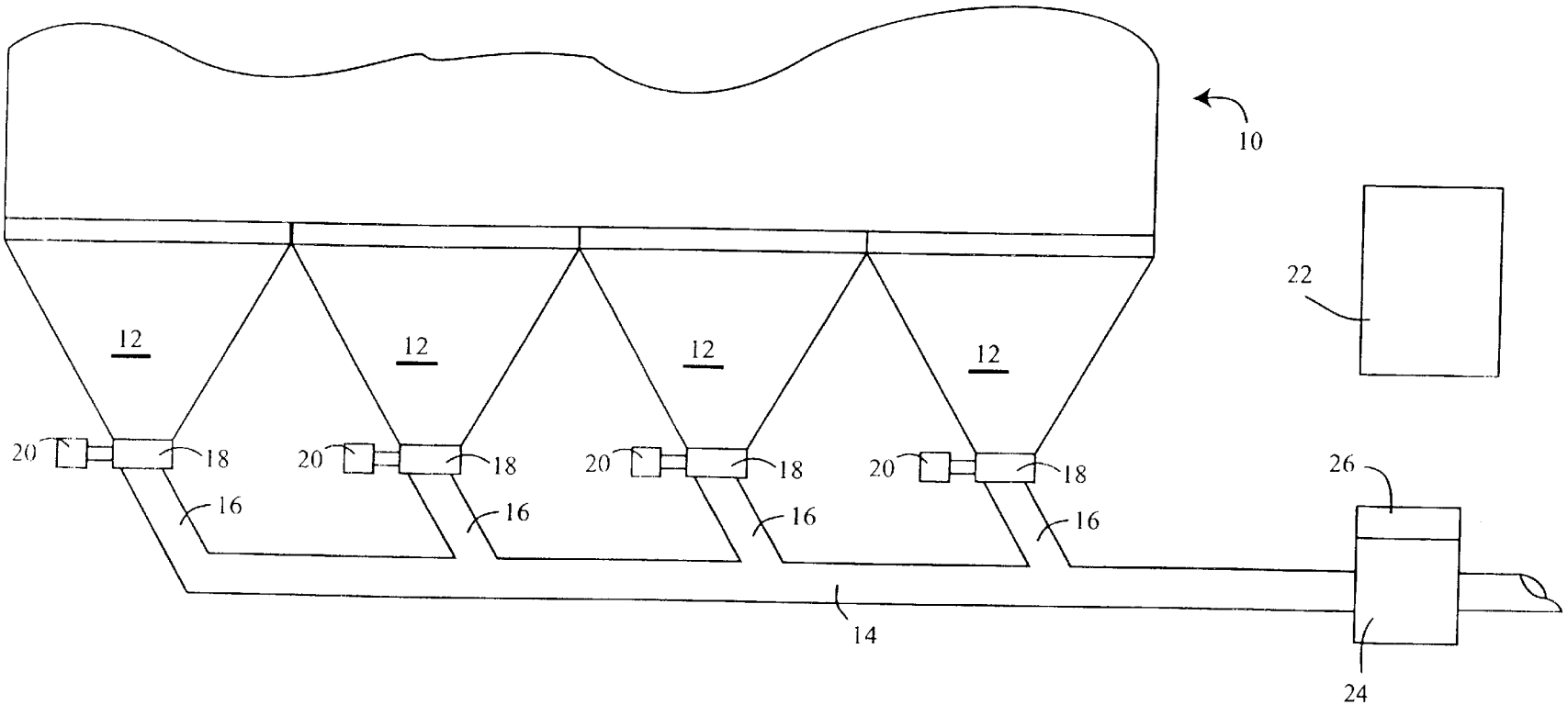
FIG. 1 is a schematic view of one type of fossil-fueled boiler incorporating the present invention.
Figure 2:
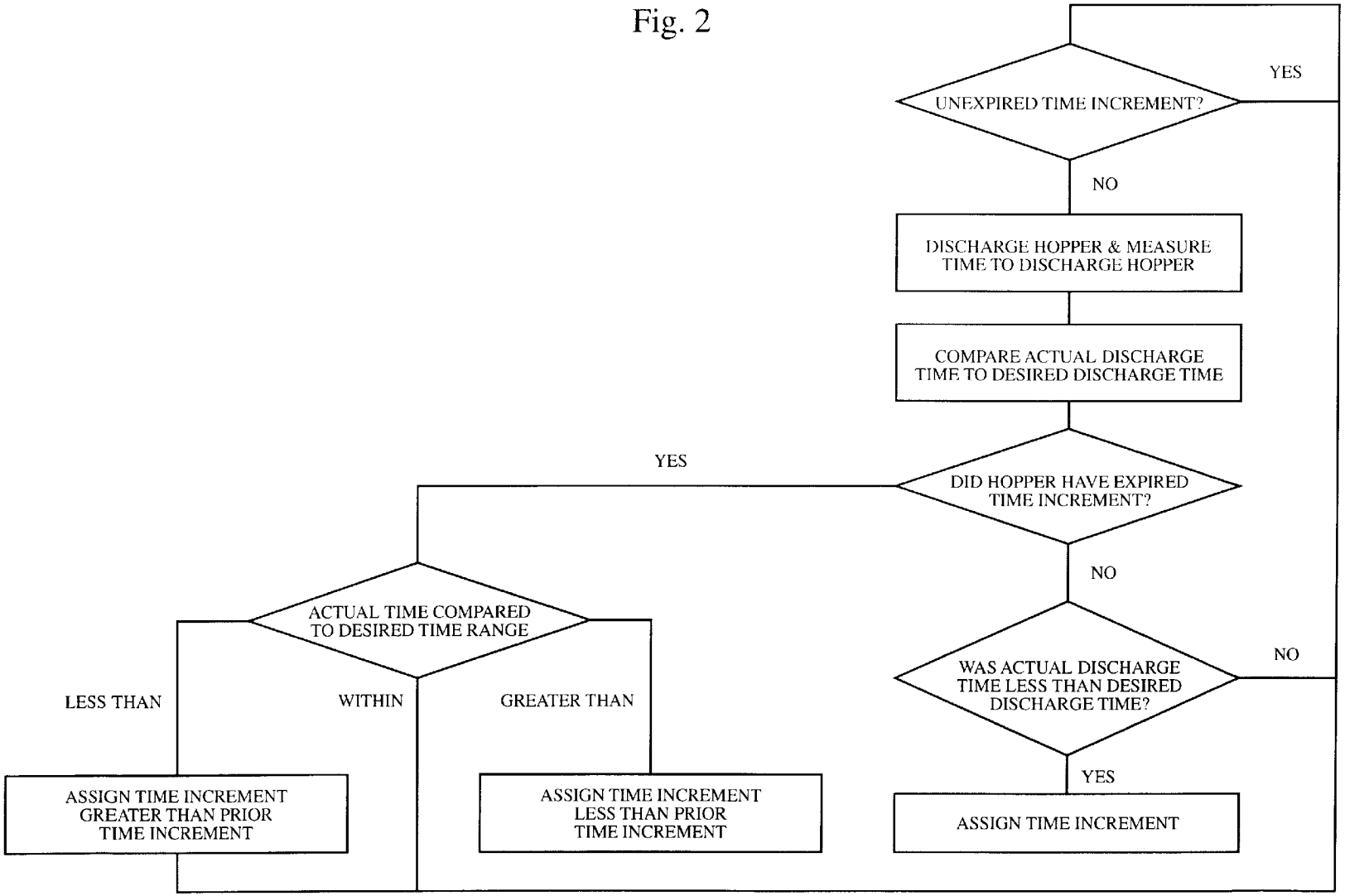
FIG. 2 is a flowchart of the process.

FIG. 1 illustrates a boiler, generally 10, including a plurality of hoppers 12. While only four hoppers are shown for sake of illustration, it will be understood that a fossil-fueled boiler will normally include a significantly larger number of hoppers. Each hopper 12 is connected to a primary discharge conduit 14 through a secondary conduit 16.

A valve 18 that is opened and closed by a valve actuator 20 is positioned in each secondary conduit 16 to control flow of ash from hopper 12 to primary conduit 14. Actuators 20 are connected to and controlled by controller 22. Ash is drawn from a given hopper 12 and through primary conduit 14 by creating a vacuum within conduit 14 using vacuum eductor 24. The load placed on eductor 24, i.e., the resistance to air being drawn through the hopper, is sensed by load sensor 26.

In initial operation, a desired time range, determined by minimum and maximum times, within which a hopper should be discharged for economical discharge conditions is determined and programmed into controller 22. On Cycle 1, each of hoppers 12 is opened in sequence and actual discharge times are measured based on a start time when gate valve 18 is opened by actuator 20, and an end time determined by a change in load conditions sensed by sensor 26.

Based on this input, the controller determines which hoppers 12 have a discharge time less than the desired time range, i.e., a below range reading. Controller 22 then assigns a time increment to each hopper with a below range reading. On Cycle 2 and subsequent cycles, each hopper having an assigned, unexpired time increment is skipped. After the assigned time increment for a given hopper 12 expires, the hopper valve 18 for the given hopper is opened on the next cycle, and the actual time required to discharge the hopper is compared with the desired time range.

If the actual discharge time is less than the minimum time of the desired time range, a new time increment is assigned to the given hopper, with the new time increment being greater than the preceding assigned time increment, i.e., the new time increment is the sum of the preceding time increment, plus a supplemental time increment. If, on the other hand, the actual time required to discharge the hopper is less that the maximum time of the desired time range, a new time increment will be assigned to the given hopper that is less than the preceding assigned time, and may be as little as zero. If the actual time is within the desired range, the assigned time increment is not changed. This evaluation is made each time a hopper valve is opened, so that adjustments can be made if operating parameters change.

If the time to open a given hopper 12 during a given cycle is determined to be below range, then the assigned time increased. If, on the other hand, the time to open a given hopper 12 during a given cycle is determined to be above range, the time increment is increased. This procedure is repeated until the actual discharge times are within range.

In summary, with the present apparatus and method, boiler ash hoppers are only opened when the amount of ash is within a desired level, as indicated by the time required to discharge ash from the hopper. Opening of a given hopper that is not filled to the desired discharge level at a given cycle is skipped until a later cycle. Hopper opening times can be adjusted based on changes in operating parameters.

Certain modifications and improvements will occur to those skilled in the art upon a reading of the foregoing description. For example, other types of sensors can be used to determine the level of ash in a hopper at a given time, or additional control valves and actuators can be added. It should be understood that all such modifications and improvements have been deleted herein for the sake of conciseness and readability but are properly within the scope of the follow claims.

What is claimed is:

1. A method for controlling the discharge of a plurality of fossil-fuel boiler hoppers in a plurality of successive discharge cycles comprising:

a) measuring the actual discharge time required to discharge each hopper during a given cycle;

b) comparing the actual discharge time for each hopper with a desired discharge time;

c) assigning a time increment to hoppers having an actual discharge time less than the desired discharge time; and d) bypassing the opening of hoppers with an assigned time increment on subsequent discharge cycles until the assigned time increment has expired.

2. The method of claim 1, wherein the actual discharge time is the time between when discharge of the hopper is started and the time when there is a change in a parameter indicating that the hopper is substantially discharged.

3. The method of claim 2, wherein said parameter is resistance to a vacuum.

4. The method of claim 1, including the step of increasing the assigned time increment following a subsequent discharge cycle.

5. The method of claim 1, including the step of decreasing the assigned time increment following a subsequent discharge cycle.

6. A method for discharging ash from a plurality of fossil-fuel boiler hoppers by opening only selected hoppers during a given discharge cycle and bypassing other hoppers comprising:

a) assigning initial time increments to one or more of said hoppers based on a comparison of actual times required to discharge said hoppers and a desired time range; and b) bypassing opening of hoppers having unexpired assigned time increments.

7. The method of claim 6, further comprising the steps of discharging hoppers with expired time increments during a given cycle, comparing the discharge times of discharged hoppers with a desired discharge time, and assigning a revised time increment to hoppers discharged in a time less than the desired time range, said revised time increment being greater than said initial time increment.

8. The method of claim 6, further comprising the steps of discharging hoppers with expired time increments during a given cycle, comparing the discharge times of discharged hoppers with a desired discharge time, and assigning a revised time increment to hoppers discharged in a time greater than the desired time range, said revised time increment being less than said initial time increment.

9. An apparatus for discharging ash from a plurality of fossil-fuel boiler hoppers, each having a hopper valve, by opening only selected hopper valves during a given discharge cycle and bypassing other hopper valves comprising:

a) an actuator associated with each hopper valve;

b) at least one sensor to detect when each hopper is discharged; and c) a controller regulating opening of selected hopper valves during a given discharge cycle, said hopper valves being selected based on information received from said sensor, said controller being adapted to compare the actual discharge time for each hopper with a desired discharge time; assign a time increment to hoppers having an actual discharge time less than the desired discharge time, and bypass the opening of hoppers with an assigned time increment on subsequent discharge cycles until the assigned time increment has expired.

10. The apparatus of claim 9, further including a discharge conduit and a vacuum eductor to sequentially draw ash from said hoppers through said conduit.

11. The apparatus of claim 9, wherein said sensor is a load sensor to measure resistance to flow of air through an open hopper.

12. A fossil-fired boiler comprising:

a) a plurality of ash hoppers, each hopper having a hopper valve;

b) an actuator associated with each of said hopper valves;

c) at least one sensor to detect when each hopper is discharged; and d) a controller regulating opening of selected hopper valves by said actuators during a given discharge cycle, said hopper valves being selected based on information received from said sensor, said controller being adapted to compare the actual discharge time for each hopper with a desired discharge time; assign a time increment to hoppers having an actual discharge time less than the desired discharge time, and bypass the opening of hoppers with an assigned time increment on subsequent discharge cycles until the assigned time increment has expired.

13. The apparatus of claim 12, further including a discharge conduit and a vacuum eductor to sequentially draw ash from said hoppers through said conduit.

14. The apparatus of claim 12, wherein said sensor is a load sensor to measure resistance to flow of air through an open hopper.

15. The apparatus of claim 12, wherein said hopper valves are selected based on a comparison of an actual discharge time with a desired discharge time range.

16. An apparatus for discharging ash from a plurality of fossil-fuel boiler hoppers, each having a hopper valve, by opening only selected hopper valves during a given discharge cycle and bypassing other hopper valves comprising:

a) an actuator associated with each hopper valve;

b) at least one sensor to detect when each hopper is discharged; and c) a controller regulating opening of selected hopper valves during a given discharge cycle, said hopper valves being selected based on information received from said sensor, said controller assigning initial time increments to one or more of said hoppers based on a comparison of actual times required to discharge said hoppers and a desired time range; and bypassing opening of hoppers having unexpired assigned time increments.

17. The apparatus of claim 16, further including a discharge conduit and a vacuum eductor to sequentially draw ash from said hoppers through said conduit.

18. The apparatus of claim 16, wherein said sensor is a load sensor to measure resistance to flow of air through an open hopper.

19. The apparatus of claim 16, wherein said valve is a gate valve.

20. The apparatus of claim 12, wherein said valve is a gate valve.

* * * * *

UNITED STATES PATENT AND TRADEMARK OFFICE
Certificate

Patent No. 6,338,306 Patented: January 15, 2002

On petition requesting issuance of a certificate for correction of inventorship pursuant to 35 U.S.C. 256, it has been found that the above identified patent, through error and without deceptive intent, improperly sets forth the inventorship.

Accordingly, it is hereby certified that the correct inventorship of this patent is: Paul E. Perrone, Lynchburg, Virginia and Brian L. Cossman, Lynchburg, Virginia.

Signed and Sealed this Tenth Day of September 2002.

IRA S. LAZARUS
*Supervisory Patent Examiner*
Art Unit 3749